United States Patent [19]

Cooper

[11] Patent Number: 4,590,461

[45] Date of Patent: May 20, 1986

[54] TAMPER RESISTANT TARGET WAFER AND FASTENER ASSEMBLY

[75] Inventor: Michael N. Cooper, Flushing, N.Y.

[73] Assignee: Knogo Corporation, Hicksville, N.Y.

[21] Appl. No.: 658,392

[22] Filed: Oct. 5, 1984

[51] Int. Cl.[4] ..... G08B 13/18; A44B 9/00

[52] U.S. Cl. ..... 340/572; 24/155 BR; 139/119; 340/693; 343/895

[58] Field of Search ..... 340/572, 693; 24/155 BR, 155 R, 150 R; 139/119, 120; 343/895, 873; 40/20 R, 22

[56] References Cited

U.S. PATENT DOCUMENTS

| | | | |
|---|---|---|---|
| 3,500,373 | 3/1970 | Minasy | 340/258 |
| 3,911,534 | 10/1975 | Martens et al. | 340/572 |
| 3,947,930 | 4/1976 | Martens et al. | 24/155 BR |
| 4,187,509 | 10/1975 | Weiner | 343/873 |
| 4,321,586 | 3/1982 | Cooper et al. | 340/572 |
| 4,339,853 | 7/1982 | Lipschitz | 24/155 BR |

*Primary Examiner*—Glen R. Swann, III

*Attorney, Agent, or Firm*—Fitzpatrick, Cella, Harper & Scinto

[57] ABSTRACT

A tamper-resistant target wafer (10) for use in an electronic theft detection system has a housing formed with bulges (16 and 22) aligned with each other on opposite sides and which slope continuously downward toward the plane of the target wafer to minimize fulcrum leverage to a prying tool and to enclose a locking mechanism (38) in a manner such that it is protected from attack by plier-like tools.

9 Claims, 5 Drawing Figures

TAMPER RESISTANT TARGET WAFER AND FASTENER ASSEMBLY

BACKGROUND OF THE INVENTION

1. Field of the Invention

This invention relates to novel target wafers and target wafer assemblies for electronic theft detection systems and more particularly it concerns novel target wafers and fasteners which contain electronic target circuits and which can be temporarily but securely attached to articles of merchandise.

2. Description of the Prior Art

In U.S. Pat. No. 3,500,373 there is described an electronic theft detection system which may be used in a retail store to protect articles of merchandise from theft. As described in that patent, a wafer is provided for each article to be protected. The wafer is a generally flat plastic element which contains a frequency selective electronic circuit and which can be temporarily, but securely, attached to the article. If any article of merchandise, having such a wafer attached to it, is carried through a checkpoint or interrogation zone, such as at or near the store exit, the electronic circuit in the wafer will react with an electromagnetic interrogation field in the checkpoint zone and will cause an alarm to be sounded.

In U.S. Pat. No. 3,911,534 (now disclaimed) there is described a ball clutch type locking mechanism by which a tack-like fastener element can be locked to a wafer containing a frequency selective electronic circuit and which allows the fastener element to be released by application of a magnetic field.

In U.S. Pat. No. 4,187,509 there is described a wafer for use in an electronic theft detection system wherein the wafer comprises a plastic housing formed with internal grooves for supporting a coil in a flat plane and internal support walls for supporting a capacitor. The wafer is also formed on one side with a dome shaped lock housing for mounting a locking mechanism and on the other side with a dome-like projection surrounding a fastener shank opening to accommodate the head of a tack like fastener.

The wafer and fastener constructions of the prior art have proved to be very practical and have been commercially successful. Nevertheless, it has been found that under certain circumstances, by insertion of a prying tool such as a screwdriver under the edge of the head of the tack-like fastener element, enough leverage can be applied on the wafer housing to pry the head and force the fastener shank out of the locking mechanism. Also, it is sometimes possible to apply plier-like cutters to the dome shaped lock housing and, by working at the housing, cut into it sufficiently to disassemble and release the locking mechanism.

SUMMARY OF THE INVENTION

The present invention provides a novel target wafer and fastener assembly which is characterized by high resistance to tampering and unauthorized removal from merchandise. More particularly this novel wafer and fastener assembly is highly resistant to unauthorized tampering by prying tools and pliers.

According to one aspect of the invention there is provided a novel target wafer for use in an electronic theft detection system which comprises a disc shaped outer housing containing an embedded electrical circuit and a fastener element locking mechanism of the type which grips the elongated shank of a tack-like fastener element. The housing is formed with a bulge on each side thereof. The bulges are mutually aligned and are of substantially the same height. The total height of the bulges is sufficient to enclose the locking mechanism so that it is oriented to hold a fastener element shank substantially perpendicular to the plane of the housing. By thus centering the locking mechanism relative to the plane of the wafer, the height of the bulge on each side of the housing is minimized and provides minimal lateral surface for attack by means of plier type tools. Moreover, the lateral surfaces of the bulge may be gently sloped to impede gripping by such tools.

According to a further aspect of the invention there is provided a target wafer assembly for use in an electronic theft detection system which comprises a target wafer having a disc shaped outer housing containing an embedded electrical circuit and a fastener element locking mechanism of the type which grips the elongated shank of a tack-like fastener element. There is also provided a tack-like fastener element having an expansive head and a thin elongated shank. The shank extends through an article of merchandise to be protected from theft and through an opening in one side of the outer housing and is gripped inside the outer housing by the locking mechanism. The outer housing is formed on its one side with a bulge having its highest point at the opening. The bulge slopes continuously downward from the opening in all directions for a distance substantially greater then the radius of the fastener element head. Because of this configuration and arrangement of the bulge, the leverage available to prying tools applied to the fastener element head is minimized.

BRIEF DESCRIPTION OF THE DRAWINGS

A preferred embodiment of the invention has been chosen for purposes of illustration and description and is shown in the accompanying drawings in which.

DETAILED DESCRIPTION OF THE PREFERRED EMBODIMENT

Figure 1:
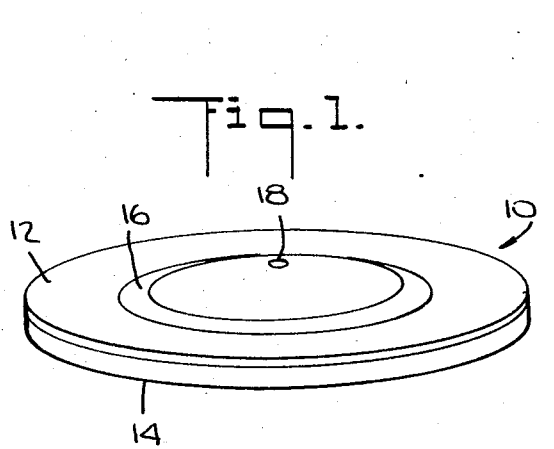
FIG. 1 is a perspective view of a novel target wafer according to the present invention.

As shown in FIG. 1 a novel target wafer 10 according to the present invention is of disc shaped outer configuration and has a fastener side housing member 12 welded or adhesively secured around its periphery to an outer side housing member 14. The fastener and outer side housing members 12 and 14 are preferably of high impact polystyrene such as, for example Shell Type P 333.

The fastener side housing member 12 is formed with a gradually sloped bulge 16 toward the center thereof;

and an opening 18 for the shank of a tack-like fastener element in formed in the center of the bulge.

Figure 2:
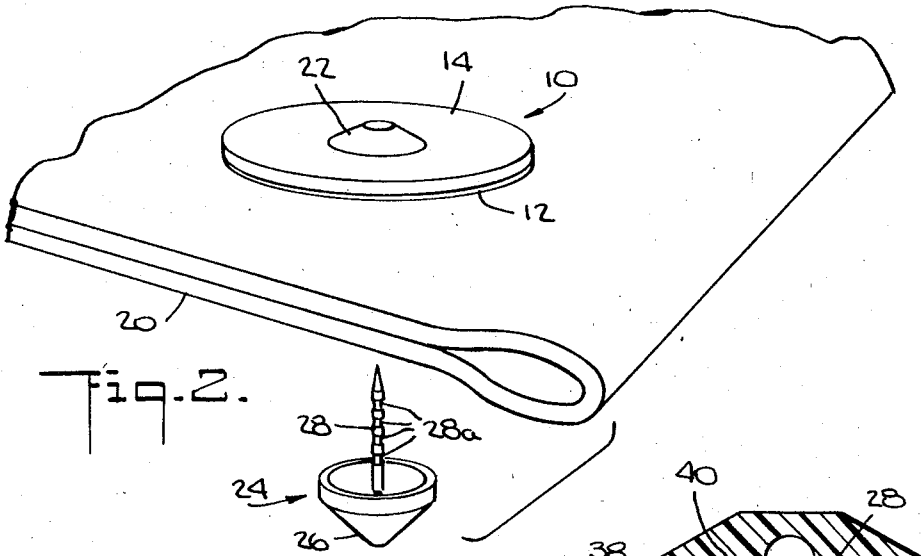
FIG. 2 is a perspective view showing in exploded fashion a fastener element and the target wafer of FIG. 1 in association with an article of merchandise.

Turning now to FIG. 2, the target wafer 10 is shown with its fastener side housing member 12 positioned against a portion of a sheet shaped article of merchandise 20 to which the target wafer is to be attached. As can be seen, a gradually sloped bulge 22 is formed on the outer side housing member 14. A tack-like fastener element 24 is shown on the opposite side of the merchandise 20 from the target wafer. The fastener element 24 has an expansive head 26 of generally conical configuration and an elongated pointed shank 28. The head 26 is preferably of a plastic material and the shank 28 is preferably of hardened steel. As can be seen, the shank 28 is formed with spaced apart circumferential grooves 28*a* which, as will be explained hereinafter, assist in locking the fastener element 24 to the target wafer 10.

In use, the target wafer 10 is secured by the fastener element 24 to the article of merchandise 20 so that it cannot be removed except by a special tool. As will also be explained; an electrical circuit is contained inside the target wafer 10 so that when it is carried with the article of merchandise 20 through a doorway, the electrical circuit will interact with electromagnetic waves produced by a theft detection monitor at the doorway and will cause an alarm to be activated. In this manner the merchandise 20 is protected from theft. When the merchandise 20 is purchased or otherwise authorized for removal through the doorway, the fastener element 24 is unlocked from the target wafer 10 with a special magnetic removal tool and the target wafer is removed from the merchandise. The merchandise can then be taken through the doorway without activating an alarm. The theft detection monitor and the magnetic removal tool are not per se part of this invention and will not be described in further detail. Suitable monitors are described in U.S. Pat. Nos. 3,500,373 and No. 4,321,586; and a suitable magnetic removal tool is described in U.S. Pat. No. 4,339,853.

Figure 3:
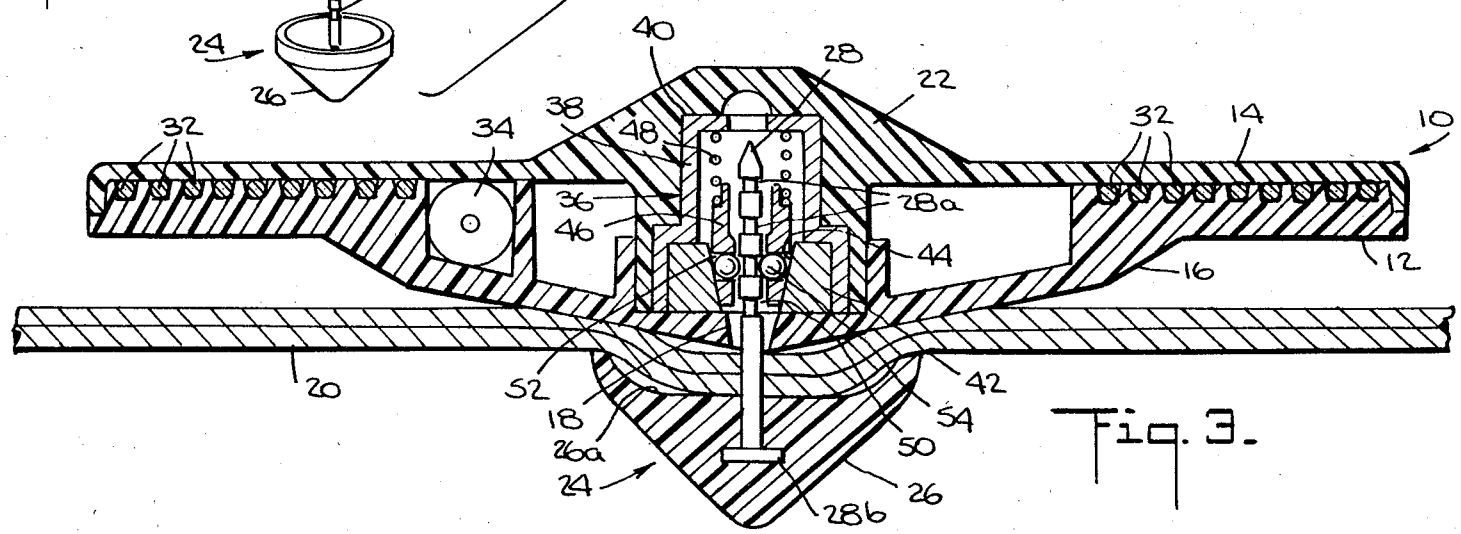
FIG. 3 is an enlarged section view of FIG. 2 but showing the fastener element assembled together with the article of merchandise and the target wafer.

As shown in FIG. 3 the fastener and outer side housing members 12 and 14 enclose a resonant electrical circuit formed of a coil 32 and a capacitor 34. The arrangement of the coil and capacitor and the manner in which they are held in place is as shown and described in U.S. Pat. No. 4,187,509. This resonant electrical circuit is tuned to resonate at a predetermined frequency and thereby produce a distinctive electrical disturbance when the circuit passes through an interrogation field being generated by a theft detection monitor at a doorway. This distinctive disturbance is detected by the monitor to sound an alarm indicating that the target wafer 10 and the article of merchandise to which it is attached are being carried through the doorway.

It will be noted that the bulges 16 and 22 formed on the fastener and outer side housing members 12 and 14 are in alignment with each other at the center of the target wafer 10. These bulges are of substantially the same height and they form a hollow central region of sufficient height to enclose a locking merchanism 36. This locking mechanism, as shown, grips the shank 28 of the fastener element 24 and holds it in a position substantially perpendicular to the plane of the housing members 12 and 14.

The locking mechanism 36 includes a cup shaped inner metal lining 38 which is press fitted into a socket 40 formed in the outer side housing member 14. A locking ring 42 is pressed into the open end of the lining 38. The locking ring is formed with an inner surface 44 which tapers toward the fastener shank opening 18. A ball carrier 46 is positioned inside the metal lining 38 and is resiliently biased against the locking ring 42 by a compression spring 48. The ball carrier 46 is formed with an axial opening 50 through which the fastener element shank 28 may extend. The ball carrier is also formed with a transverse passageway 52 in the vicinity of the locking ring 42. This transverse opening, which intersects the axial opening 50 is provided with locking balls 54 which wedge between the tapered inner surface of the locking ring 42 and the fastener element shank 28 to grip the shank and lock it in place when the carrier 46 is forced against the ring 42 by the spring 48. Actually the balls 54 locate themselves in one of the circumferential grooves 28*a* of the shank 28 to provide a very secure gripping action. In this manner the fastener element 24 holds the target wafer 10 tightly to the article of merchandise 20. The target wafer 10 cannot be removed except by a special magnet tool which develops sufficient force to pull the carrier 46 back against the bias of the spring 48 and allow the balls 54 to move back and out from the fastener element shank grooves 28*a*.

It will be noted that the bulge 16 on the fastener side housing member 12 extends beyond the fastener element head 26 in every direction for a distance substantially greater than the radius of the fastener element head. Preferably the diameter of the bulge 16 is at least twice the diameter of the fastener element head. The highest point of the bulge 16 is at the fastener element opening 18. Moreover, the bulge 16 slopes gradually but continuously downwardly from the opening 18 toward the plane of the target wafer. The fastener element head 26 in turn is formed with a concave bottom surface 26*a* which allows it to press the material of the merchandise 20 down over the bulge 16 and to press down and hold the merchandise material tightly between its periphery and the bulge 16 when its shank 28 is held by the locking mechanism 36. It will also be noted that the metal shank 28 of the fastener element 24 has an integrally formed flanged head 28*b* which is embedded in the plastic material of the expansive head 26.

The above described target wafer and fastener assembly is strong and light in weight and it is securely held to the merchandise 20 without damage to the merchandise. At the same time the target wafer may easily be removed from the merchandise by means of a special magnetic tool as above described.

Figure 4:
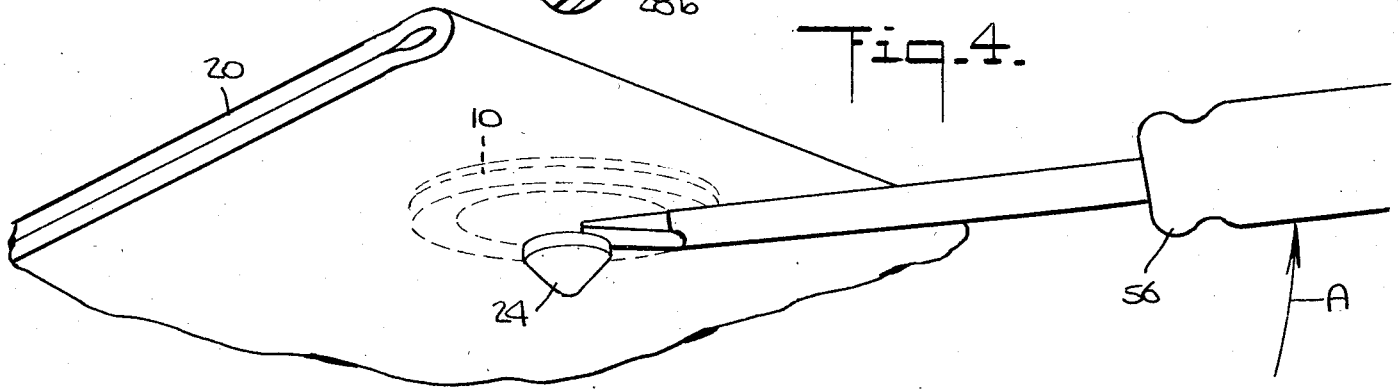
FIG. 4 is a perspective view showing a screwdriver being used in an attempt to force a fastener element out of a target wafer of the present invention.

The target wafer and fastener assembly of the present invention is also highly resistant to tampering. FIG. 4 shows a typical technique which is often used in effort to remove target wafers from merchandise in an unauthorized manner. As shown in FIG. 4, a prying tool, such as a screwdriver 56, is forced under the edge of the fastener head 26 and then the handle of the tool is moved in the direction of the arrow A to force the shank 28 out from the target wafer 10.

Figure 5:
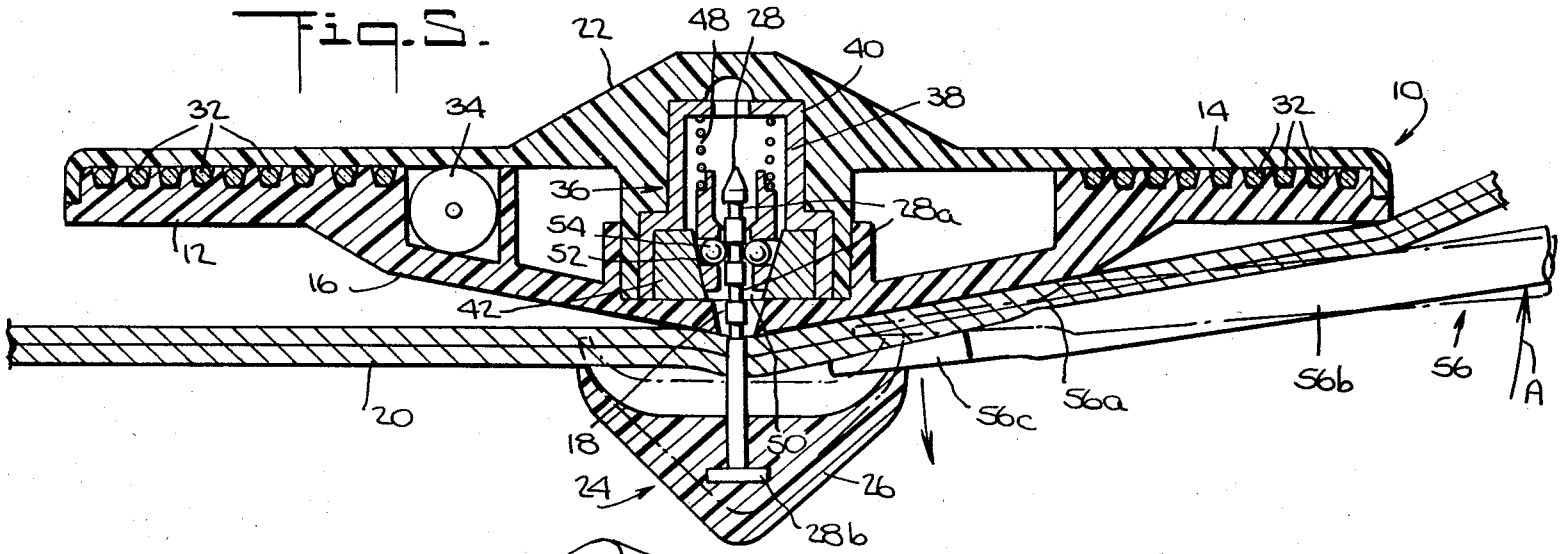
FIG. 5 is an enlarged section view showing the manner in which the shape of the novel target wafer of the present invention impedes prying off of a fastener element.

Turning now to FIG. 5, it will be seen that because of the bulge 16 which slopes continuously downwardly beyond the fastener element head 28, no fulcrum is available to the prying tool 56 except at the outer edge of the target wafer. This minimizes the leverage availabe for prying the fastener element out of the locking mechanism 36.

The prying tool 56 may be formed with its own fulcrum as for example, the intersection 56*a* between the shank 56*b* and the blade 56*c* of the screwdriver. In such case it may be possible under some circumstances to force the fastener element 24 part way out from the target wafer. However, as can be seen in FIG. 5, the balls 54 will simply grip the next successive circumferential groove 28*a* in the fastener element shank to hold the fastener element against further withdrawal. At this point there is no further fulcrum available to the prying tool except at the outer edge of the target wafer.

The target wafer of this invention also resists tampering by means of pincers or plier-like tools which are used to attack the locking mechanism 36. As can be seen, the bulges 16 and 22 on the fastener and outer side housing members 12 and 14 are in alignment with each other and extend approximately the same distance out from each side of the target wafer 10. Consequently the amount by which the locking mechanism 36 projects out beyond the plane of the wafer is minimized. Furthermore, the bulges 16 and 22 are gradually sloped and therefore do not afford any gripping surface for a plier-like tool which may be applied to cut into the locking mechanism. Preferably the sides or lateral surfaces of the bulges should slope at an angle substantially less than 45° from the plane of the target wafer housing.

The target wafer of the present invention may be made to be very compact and lightweight. Preferably the coil 32 comprises about seven turns of 0.028 inches (0.71 mm) diameter copper wire extending from an inner diameter of about one and one half inches (3.81 cm) to an outer diameter of about two and three eighths inches (6.03 cm). Such coil has an inductance of 3.39 microhenries. If the capacitance of the capacitor 34 is chosen to be 1906 picofarads, the resonant frequency of the circuit will be 1980 kilohertz and the Q of the circuit will be 110. If the capacitance of the capacitor is chosen to be 702 picofarads, the resonant frequency of the circuit will be 3250 kilohertz and the Q will be 160.

Prior art target wafers which utilized coils of bare wire embedded into preformed spiral grooves utilized aluminum wire. It has been found that by using copper wire instead of aluminum, the electrical response characteristics of the target wafer can be maintained and at the same time its outer diameter may be substantially reduced.

I claim:

1. A target wafer for use in an electronic theft detection system, said target wafer comprising a disc shaped outer housing containing an embedded electrical circuit and a fastener element locking mechanism of the type which grips the elongated shank of a tack-like fastener element, said housing being formed with a bulge on each side thereof, said bulges being mutually aligned and of substantially the same height and the total height of said bulges being sufficient to enclose said locking mechanism oriented to hold a fastener element shank substantially perpendicular to the plane of said housing.

2. A target wafer according to claim 1 wherein said bulges are centered on said housing.

3. A target wafer according to claim 1 wherein said bulges slope downwardly continuously in all directions from their highest point.

4. A target wafer according to claim 1 wherein the slope of said bulges is less than 45° with respect to the plane of said housing.

5. A target wafer assembly for use in an electronic theft detection system, said assembly comprising a target wafer having a disc shaped outer housing containing an embedded electrical circuit and a fastener element locking mechanism of the type which grips the elongated shank of a tack-like fastener element, a tack-like fastener element having an expansive head and a thin elongated shank, said shank extending through an article of merchandise to be protected from theft and through an opening in one side of said outer housing and being gripped inside said outer housing by said locking mechanism, said outer housing being formed on said one side with a bulge having its highest point at said opening and sloping continuously downward therefrom in all directions for a distance substantially greater than the radius of the fastener element head, whereby the contour of said bulge minimizes the leverage available to a prying tool applied to the fastener element head.

6. A target wafer assembly according to claim 5 wherein said opening is centrally located on said housing.

7. A target wafer assembly according to claim 5 wherein said bulge extends over a distance at least twice the diameter of the expansive head of said tack-like fastener element.

8. A target wafer assembly according to claim 5 wherein the shank of said tack-like fastener element is formed with spaced apart circumferential grooves and wherein said locking mechanism includes locking balls which fit into said grooves.

9. A target wafer assembly according to claim 5 wherein said housing is formed on its opposite side with a bulge which is aligned with and of substantially the same height as the bulge on said one side, the total height of said bulges being sufficient to enclose said locking mechanism oriented to hold said shank of said tack-like fastener element perpendicular to the plane of said housing.

* * * * *